US008250885B2

(12) United States Patent
Han et al.

(10) Patent No.: US 8,250,885 B2
(45) Date of Patent: Aug. 28, 2012

(54) LAUNDRY MACHINE

(75) Inventors: Dong Joo Han, Gyeongsangnam-do (KR); Young Bok Son, Gyeongsangnam-do (KR); Jae Yoen Lim, Gyeongsangnam-do (KR); Ki Chul Cho, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 411 days.

(21) Appl. No.: 12/432,422

(22) Filed: Apr. 29, 2009

(65) Prior Publication Data

US 2010/0083710 A1 Apr. 8, 2010

(30) Foreign Application Priority Data

Apr. 30, 2008 (KR) ..... 10-2008-0040598
Apr. 30, 2008 (KR) ..... 10-2008-0040612

(51) Int. Cl.
*D06F 25/00* (2006.01)

(52) U.S. Cl. ..... 68/3 R; 68/19.1; 68/20

(58) Field of Classification Search ..... 68/3 R, 68/19.1, 20; 72/379.6
See application file for complete search history.

(56) References Cited

U.S. PATENT DOCUMENTS 2,165,487 A * 7/1939 Johnson ..... 68/18 C
2,351,429 A * 6/1944 Huebsch ..... 34/127
2,369,366 A 2/1945 O'Neill
2,486,058 A 10/1949 Patterson et al.
2,543,579 A 2/1951 Kauffmann, II
2,547,238 A 4/1951 Tremblay
2,566,488 A * 9/1951 Gould ..... 68/20
2,611,192 A 9/1952 Huebsch
2,687,578 A 8/1954 Richterkessing
2,707,837 A 5/1955 Robinson et al.
2,716,820 A 9/1955 Bourner
2,722,057 A 11/1955 Pugh
2,727,315 A 12/1955 Candor
2,728,481 A 12/1955 Robinson et al.
2,742,708 A 4/1956 McCormick
2,752,004 A 6/1956 Hullar
2,795,055 A 6/1957 Huebsch
2,813,353 A 11/1957 McMillan
2,816,429 A * 12/1957 Kurlancheek ..... 68/19.2
2,817,157 A 12/1957 McCormick
2,817,501 A 12/1957 Schubert
2,843,945 A 7/1958 Whyte
2,861,355 A 11/1958 Douglas
2,867,430 A 1/1959 Hullar
2,903,799 A 9/1959 Sachaczenski (Continued)

FOREIGN PATENT DOCUMENTS

CN 2157212 Y 2/1994

(Continued)

OTHER PUBLICATIONS

European Patent Office 0 666 355 May 1995.*

*Primary Examiner* — Frankie L Stinson
(74) *Attorney, Agent, or Firm* — Birch, Stewart, Kolasch & Birch, LLP

(57) ABSTRACT

A laundry machine includes a cabinet and a partition wall dividing an inner space of the cabinet into a first space for main laundry treatment and a second space for auxiliary laundry treatment. An air supply unit is provided outside of the second space and supplies a downward airflow into the second space.

16 Claims, 8 Drawing Sheets

U.S. PATENT DOCUMENTS

| | | | | |
|---|---|---|---|---|
| 2,904,895 | A | 9/1959 | Bochan | |
| 2,985,967 | A | 5/1961 | Pataillot et al. | |
| 3,000,108 | A | 9/1961 | Jones et al. | |
| 3,001,295 | A | 9/1961 | Miller | |
| 3,023,514 | A | 3/1962 | Gibson | |
| 3,061,942 | A | 11/1962 | Scofield | |
| 3,064,358 | A | 11/1962 | Giuffre | |
| 3,121,000 | A * | 2/1964 | Hubbard | 34/75 |
| 3,383,776 | A * | 5/1968 | Wilhoyte | 34/562 |
| 3,402,477 | A * | 9/1968 | Hubbard | 34/543 |
| 3,555,701 | A * | 1/1971 | Hubbard | 34/602 |
| 3,579,851 | A | 5/1971 | Elmy | |
| 3,789,514 | A | 2/1974 | Faust et al. | |
| 3,840,998 | A | 10/1974 | Marcussen | |
| 4,557,058 | A | 12/1985 | Ozawa et al. | |
| 4,653,200 | A | 3/1987 | Werner | |
| 5,062,219 | A | 11/1991 | Harris et al. | |
| 5,136,792 | A | 8/1992 | Janecke | |
| 5,165,181 | A | 11/1992 | Acosta, Sr. et al. | |
| 5,279,047 | A | 1/1994 | Janecke | |
| 5,443,538 | A | 8/1995 | Little | |
| 5,560,120 | A | 10/1996 | Swanson et al. | |
| 5,664,339 | A | 9/1997 | Swanson et al. | |
| 5,784,901 | A | 7/1998 | Yanase et al. | |
| 6,016,610 | A | 1/2000 | Sears | |
| 6,094,839 | A * | 8/2000 | Nikolov | 34/225 |
| 6,151,795 | A | 11/2000 | Hoffman et al. | |
| 6,374,644 | B1 | 4/2002 | Rhode et al. | |
| 6,618,887 | B2 | 9/2003 | Kim et al. | |
| 6,671,978 | B1 * | 1/2004 | McGowan et al. | 34/596 |
| 6,732,553 | B2 | 5/2004 | Rhode et al. | |
| 6,978,556 | B1 * | 12/2005 | Cornelious | 34/596 |
| 7,036,243 | B2 | 5/2006 | Doh et al. | |
| 7,055,262 | B2 | 6/2006 | Goldberg et al. | |
| 7,065,904 | B2 | 6/2006 | Lee et al. | |
| 7,251,905 | B2 | 8/2007 | Doh et al. | |
| 7,281,775 | B2 | 10/2007 | Yang | |
| 7,404,303 | B1 | 7/2008 | Barbosa et al. | |
| 7,497,030 | B2 | 3/2009 | Belgard | |
| 7,520,145 | B2 | 4/2009 | Hong et al. | |
| 7,591,082 | B2 | 9/2009 | Lee et al. | |
| 7,624,601 | B2 | 12/2009 | Ikemizu et al. | |
| 7,644,515 | B2 | 1/2010 | Doh | |
| 7,665,225 | B2 | 2/2010 | Goldberg et al. | |
| 7,665,227 | B2 | 2/2010 | Wright et al. | |
| 7,673,358 | B2 | 3/2010 | Dietz et al. | |
| 7,707,858 | B2 | 5/2010 | Jeon et al. | |
| 7,707,860 | B2 | 5/2010 | Hong et al. | |
| 7,735,345 | B2 | 6/2010 | Wright et al. | |
| 7,748,139 | B2 | 7/2010 | Hong et al. | |
| 7,836,607 | B2 | 11/2010 | Kim | |
| 7,849,717 | B2 * | 12/2010 | Sunshine | 68/13 R |
| 7,895,770 | B2 | 3/2011 | Bae et al. | |
| 7,913,419 | B2 * | 3/2011 | Tomasi et al. | 34/595 |
| 7,921,578 | B2 | 4/2011 | McAllister et al. | |
| 7,921,679 | B2 | 4/2011 | Jo | |
| 2002/0017117 | A1 | 2/2002 | Sunshine et al. | |
| 2002/0092329 | A1 | 7/2002 | Rhode et al. | |
| 2002/0154011 | A1 | 10/2002 | Pasin et al. | |
| 2003/0079368 | A1 | 5/2003 | Hoffman | |
| 2004/0134237 | A1 | 7/2004 | Sunshine et al. | |
| 2005/0066538 | A1 | 3/2005 | Goldberg et al. | |
| 2005/0066999 | A1 | 3/2005 | Dietz et al. | |
| 2005/0120585 | A1 | 6/2005 | Lee et al. | |
| 2005/0126035 | A1 | 6/2005 | Lee et al. | |
| 2005/0132593 | A1 | 6/2005 | Doh et al. | |
| 2005/0132594 | A1 | 6/2005 | Doh et al. | |
| 2005/0132604 | A1 | 6/2005 | Hong et al. | |
| 2006/0075790 | A1 | 4/2006 | Jeon et al. | |
| 2006/0112585 | A1 | 6/2006 | Choi et al. | |
| 2006/0123853 | A1 | 6/2006 | Hong et al. | |
| 2006/0156765 | A1 | 7/2006 | Sunshine et al. | |
| 2006/0179676 | A1 | 8/2006 | Goldberg et al. | |
| 2006/0186222 | A1 | 8/2006 | Ikemizu et al. | |
| 2006/0289533 | A1 | 12/2006 | Park et al. | |
| 2007/0062513 | A1 | 3/2007 | Gagas | |
| 2007/0068034 | A1 | 3/2007 | Kim | |
| 2007/0113419 | A1 | 5/2007 | Belgard | |
| 2007/0119072 | A1 | 5/2007 | Kim | |
| 2007/0144031 | A1 | 6/2007 | Lee | |
| 2007/0151041 | A1 | 7/2007 | McAllister et al. | |
| 2007/0151120 | A1 | 7/2007 | Tomasi et al. | |
| 2007/0151129 | A1 | 7/2007 | McAllister et al. | |
| 2007/0151301 | A1 | 7/2007 | Kendall et al. | |
| 2007/0151310 | A1 | 7/2007 | Wright et al. | |
| 2007/0151311 | A1 | 7/2007 | McAllister et al. | |
| 2007/0151312 | A1 | 7/2007 | Bruce et al. | |
| 2007/0163093 | A1 | 7/2007 | Wright et al. | |
| 2007/0163094 | A1 | 7/2007 | Wright et al. | |
| 2007/0163095 | A1 | 7/2007 | McAllister et al. | |
| 2007/0163096 | A1 | 7/2007 | McAllister et al. | |
| 2007/0163097 | A1 | 7/2007 | Metcalfe et al. | |
| 2007/0163098 | A1 | 7/2007 | Tomasi et al. | |
| 2007/0249212 | A1 | 10/2007 | Buecker et al. | |
| 2008/0006224 | A1 | 1/2008 | Ahn et al. | |
| 2008/0052950 | A1 | 3/2008 | Park et al. | |
| 2008/0053162 | A1 | 3/2008 | Park et al. | |
| 2008/0053163 | A1 | 3/2008 | Park et al. | |
| 2008/0053164 | A1 | 3/2008 | Park et al. | |
| 2008/0053166 | A1 | 3/2008 | Lim | |
| 2008/0141550 | A1 | 6/2008 | Bae et al. | |
| 2008/0141552 | A1 | 6/2008 | Bae et al. | |
| 2008/0141554 | A1 | 6/2008 | Bae et al. | |
| 2008/0141557 | A1 | 6/2008 | Son et al. | |
| 2008/0141558 | A1 | 6/2008 | Bae et al. | |
| 2008/0141734 | A1 | 6/2008 | Son et al. | |
| 2008/0148494 | A1 | 6/2008 | Son et al. | |
| 2008/0163651 | A1 | 7/2008 | Jeong et al. | |
| 2008/0168679 | A1 | 7/2008 | Son et al. | |
| 2008/0252189 | A1 * | 10/2008 | Regan | 312/249.8 |
| 2008/0256989 | A1 | 10/2008 | Jeong et al. | |
| 2008/0271263 | A1 | 11/2008 | Bae et al. | |
| 2008/0271336 | A1 | 11/2008 | Doh | |
| 2008/0271500 | A1 | 11/2008 | Ahn | |
| 2008/0276659 | A1 | 11/2008 | Bae et al. | |
| 2008/0276660 | A1 | 11/2008 | Bae et al. | |
| 2008/0276661 | A1 | 11/2008 | Bae et al. | |
| 2008/0282745 | A1 | 11/2008 | Han et al. | |
| 2009/0057527 | A1 | 3/2009 | Jo | |
| 2009/0113745 | A1 | 5/2009 | Choi et al. | |
| 2009/0113755 | A1 | 5/2009 | Choi et al. | |
| 2009/0126222 | A1 | 5/2009 | Bae et al. | |
| 2009/0126421 | A1 | 5/2009 | Kim et al. | |
| 2009/0133281 | A1 | 5/2009 | Yoon et al. | |
| 2009/0133284 | A1 | 5/2009 | Belgard | |
| 2009/0158616 | A1 | 6/2009 | Ricklefs et al. | |
| 2009/0193856 | A1 | 8/2009 | Park et al. | |
| 2009/0235551 | A1 | 9/2009 | Jo et al. | |
| 2009/0241606 | A1 | 10/2009 | Yoo et al. | |
| 2009/0260246 | A1 | 10/2009 | Bae et al. | |
| 2009/0265953 | A1 | 10/2009 | Bae et al. | |
| 2009/0277036 | A1 | 11/2009 | Lee et al. | |
| 2009/0277037 | A1 | 11/2009 | Lim | |
| 2009/0288456 | A1 | 11/2009 | Bae et al. | |
| 2009/0320313 | A1 | 12/2009 | Bae et al. | |
| 2010/0000112 | A1 | 1/2010 | Carow et al. | |
| 2010/0000114 | A1 | 1/2010 | Dalton et al. | |
| 2010/0000117 | A1 | 1/2010 | Choi et al. | |
| 2010/0005681 | A1 | 1/2010 | Jo et al. | |
| 2010/0011609 | A1 | 1/2010 | Park et al. | |
| 2010/0018262 | A1 | 1/2010 | Beihoff et al. | |
| 2010/0024243 | A1 | 2/2010 | Ricklefs et al. | |
| 2010/0077801 | A1 | 4/2010 | Son et al. | |
| 2010/0083521 | A1 | 4/2010 | Han et al. | |
| 2010/0083708 | A1 | 4/2010 | Han et al. | |
| 2010/0083709 | A1 | 4/2010 | Han et al. | |
| 2010/0083710 | A1 | 4/2010 | Han et al. | |
| 2010/0083711 | A1 | 4/2010 | Han et al. | |
| 2010/0115784 | A1 | 5/2010 | Jo et al. | |
| 2010/0146812 | A1 | 6/2010 | Ahn et al. | |
| 2010/0182136 | A1 | 7/2010 | Pryor | |
| 2010/0186176 | A1 | 7/2010 | Wright et al. | |
| 2010/0192397 | A1 | 8/2010 | Kim et al. | |
| 2010/0206016 | A1 | 8/2010 | Bae et al. | |
| 2010/0231506 | A1 | 9/2010 | Pryor | |
| 2010/0281929 | A1 | 11/2010 | Han et al. | |
| 2010/0327766 | A1 | 12/2010 | Recker et al. | |

| | | | |
|---|---|---|---|
| 2011/0005276 | A1 | 1/2011 | Moon et al. |
| 2011/0016928 | A1 | 1/2011 | Beihoff et al. |
| 2011/0030147 | A1 | 2/2011 | Yoo et al. |
| 2011/0030428 | A1 | 2/2011 | Han et al. |
| 2011/0047814 | A1 | 3/2011 | Watson et al. |
| 2011/0067457 | A1 | 3/2011 | Han et al. |
| 2011/0083338 | A1 | 4/2011 | Carow et al. |

FOREIGN PATENT DOCUMENTS

| | | | | |
|---|---|---|---|---|
| CN | 1349012 | A | | 5/2002 |
| CN | 2317357 | C2 | | 2/2008 |
| CN | 101153455 | A | | 4/2008 |
| CN | 101153456 | A | | 4/2008 |
| DE | 203 02 572 | U1 | | 4/2003 |
| EP | 0627519 | A1 | | 12/1994 |
| EP | 1353004 | A1 | | 10/2003 |
| EP | 1 524 356 | A1 | | 4/2005 |
| EP | 1726703 | A1 | | 11/2006 |
| FR | 1473011 | | * | 10/1965 |
| GB | 1510528 | A | | 5/1978 |
| GB | 1 545 078 | | | 5/1979 |
| JP | 54-108060 | | * | 8/1979 |
| JP | 54-108060 | A | | 8/1979 |
| JP | 60-238693 | A | | 11/1985 |
| JP | 60-238695 | A | | 11/1985 |
| JP | 1-266000 | A | | 10/1989 |
| JP | 2-128797 | A | | 5/1990 |
| JP | 3-126490 | A | | 5/1991 |
| JP | 3-289999 | A | | 12/1991 |
| JP | 4-126195 | A | | 4/1992 |
| JP | 04-187194 | | * | 7/1992 |
| JP | 4-338495 | A | | 11/1992 |
| JP | 4-367697 | A | | 12/1992 |
| JP | 5-49795 | A | | 3/1993 |
| JP | 5-49796 | A | | 3/1993 |
| JP | 6-293 | A | | 1/1994 |
| JP | 6-134187 | A | | 5/1994 |
| JP | 6-190193 | A | | 7/1994 |
| JP | 6-254296 | A | | 9/1994 |
| JP | 6-277396 | A | | 10/1994 |
| JP | 07-148394 | A | | 6/1995 |
| JP | 8-155194 | A | | 6/1996 |
| JP | 8-196798 | A | | 8/1996 |
| JP | 8-229298 | A | | 9/1996 |
| KR | 2001-0088209 | A | | 9/2001 |
| KR | 2003016860 | | * | 7/2003 |
| KR | 10-2005-0115968 | A | | 12/2005 |
| KR | 10-2005-0115969 | A | | 12/2005 |
| RU | 2291922 | C2 | | 1/2007 |
| RU | 2317357 | C2 | | 2/2008 |
| SU | 1687682 | A1 | | 10/1991 |
| WO | WO 2008/013411 | A2 | | 1/2008 |
| WO | WO-2008/013413 | A2 | | 1/2008 |
| WO | WO-2008/023910 | A2 | | 2/2008 |
| WO | WO-2008/123699 | A2 | | 10/2008 |
| WO | WO-2008/127027 | A2 | | 10/2008 |

* cited by examiner

LAUNDRY MACHINE

CROSS REFERENCE TO RELATED APPLICATION

This application claims the benefit of the Korean Patent Applications. No. 10-2008-0040612 and 10-2008-0040598, filed on Apr. 30, 2008, which are hereby incorporated by reference as if fully set forth herein.

BACKGROUND OF THE DISCLOSURE

1. Field of the Disclosure

The present invention relates to a laundry machine.

2. Discussion of the Related Art

Generally, laundry machines are home appliances that are used to clean laundry by washing and drying laundry, using detergent and mechanical friction. Laundry machines are categorized into washing machines, dryers and single appliances performing both washing and drying functions.

SUMMARY OF THE DISCLOSURE

The present invention is directed to a laundry machine.

An object of the present invention is to provide a laundry machine with enhanced laundering efficiency, and which has an improved overall exterior appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet, and a partition partitioning an inner space of the cabinet into a first space for main washing treatment of laundry and a second space for auxiliary washing treatment of the laundry. The partition may be a single partition wall.

The single partition wall may form a base of the first space and a top cover of the second space.

The laundry machine may further include an air supply unit for supplying air to the second space.

The air supply unit may be detachable from a top surface of the partition wall.

The air supply unit may supply air inside the first space to the second space.

A recess portion may be provided in the top surface of the partition wall, and the air supply unit may be positioned in the recess portion.

An air inlet may be provided in the recess portion, and an outlet of the air supply unit may be connected with the air inlet. The outlet may be substantially perpendicular to the air inlet.

The air supply unit may include a housing detachably secured on the partition wall, the housing forming a path which air flows along, and a fan blowing the air along the path.

In another aspect of the present invention, a laundry machine includes a cabinet; a single partition wall partitioning an inner space of the cabinet into a main space and an auxiliary space; and an air supply unit provided at the single partition wall, the air supply unit for supplying air to the auxiliary space.

The main space may form an air drawing space where air is drawn into the air supply unit, and the auxiliary space may form an air discharging space where air is discharged from the air supply unit.

The auxiliary space may be provided in an air discharging path of the air supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
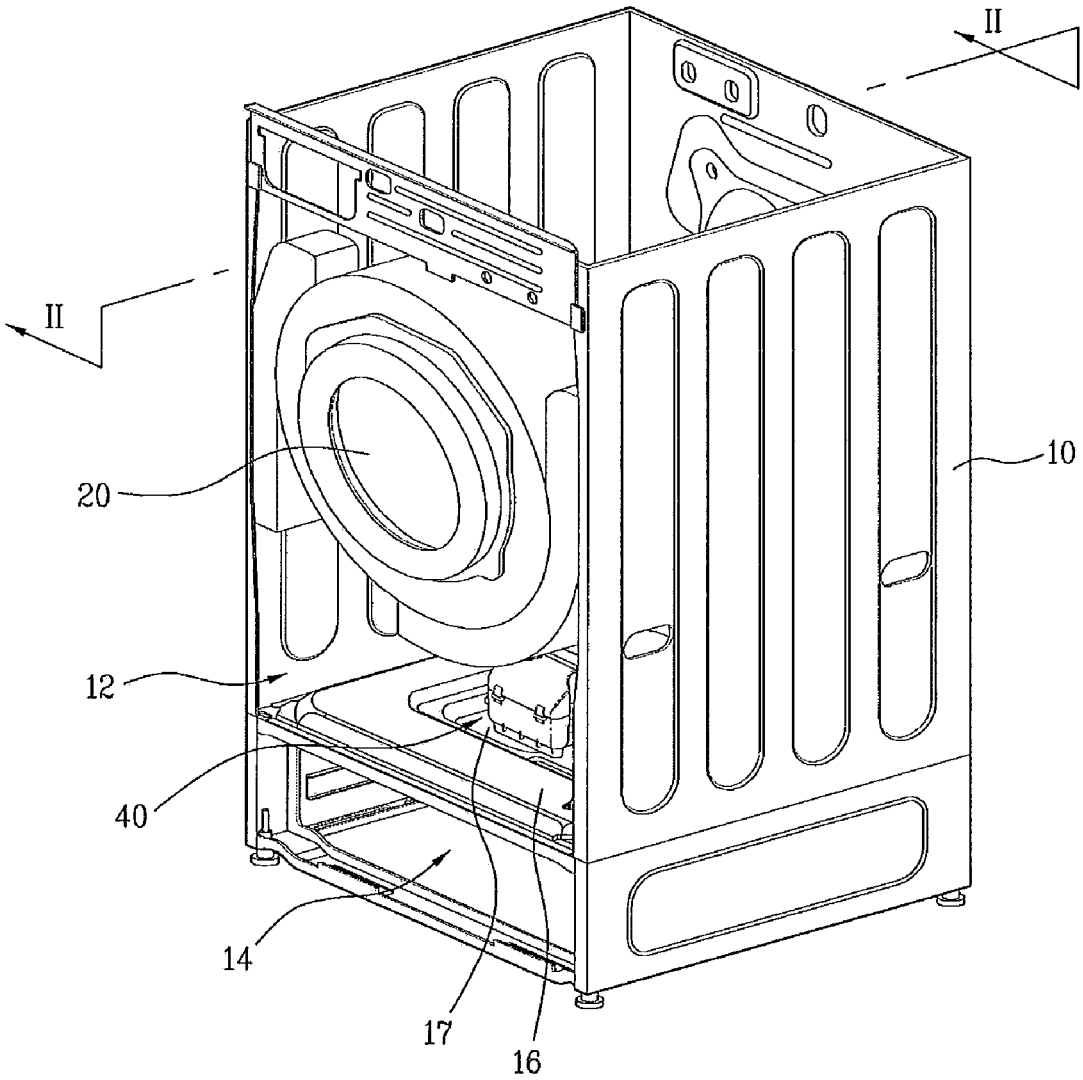
FIG. 1 is a perspective view illustrating a laundry machine according to an exemplary embodiment of the present invention.
Figure 2:
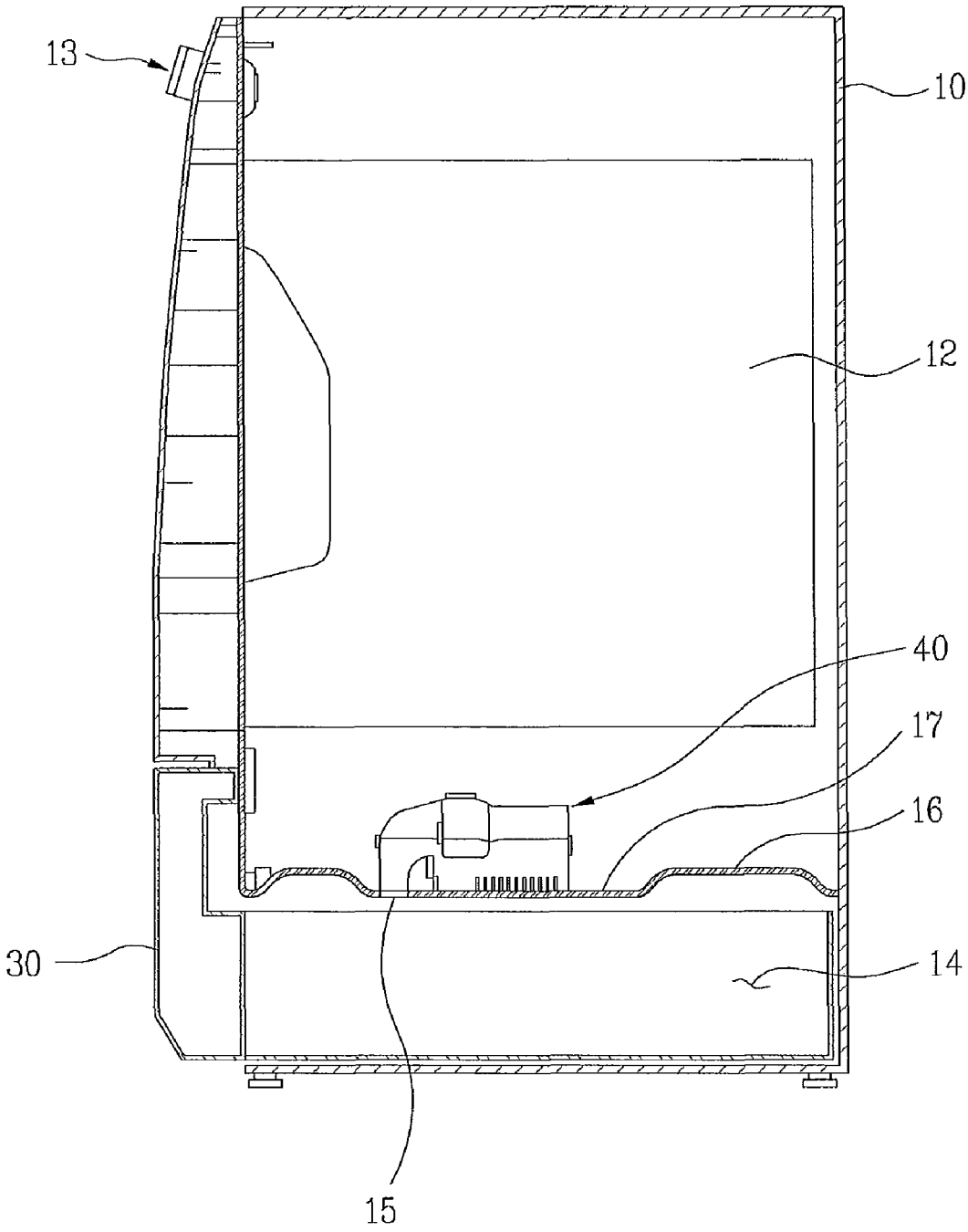
FIG. 2 is a sectional view taken along line II-II shown in FIG. 1.

In reference to FIGS. 1 and 2, a laundry machine includes a cabinet 10 and a partition 16. The partition 16 partitions the inner space into at least two spaces. The partition 16 may be a single partition, which will be described in detail later. The single partition 16 may partition the inner space of the cabinet 10 into a first space or main space 12 and a second space or auxiliary space 14. Main laundry treatment for the laundry may be performed in the first space or main space 12. The first laundry treatment space 12 may include a laundry washing apparatus or a laundry drying apparatus. Auxiliary laundry treatment for the laundry may be performed in the second space or auxiliary space 14. A selector 13 is provided at the cabinet 10 to permit a user to select the desired laundry operations.

Here, the above main laundry treatment may mean conventional washing and/or drying operations, and auxiliary laundry treatment may mean additional washing, drying or refreshing operations for the laundry, or may mean drying or refreshing operations for small-sized laundry. The term 'refreshing' may mean a process of removing wrinkles, deodorizing, sanitizing, preventing static electricity, or warming the laundry by supplying air, heated air, steam, mist or water to the laundry. The term 'laundry' may include not only clothes but also all kinds of wearable objects and apparel such as shoes, socks, gloves and hats. Thus, laundry means all kinds of laundry to which laundering operations can be performed.

The cabinet 10 defines an exterior appearance of the laundry machine. Various components may be mounted in the cabinet 10. A rotatable drum 20 may be provided in the first space 12 inside the cabinet 10, and a detachable drawer 30 may be provided in the second space 14. The drum 20 and the drawer 30 are each configured to receive laundry therein. If the laundry machine is configured as a washing machine or a single appliance having both washing and drying functions, a tub (not shown) for accommodating wash water may be further provided, and the drum 20 may be provided within the tub.

Figure 8:
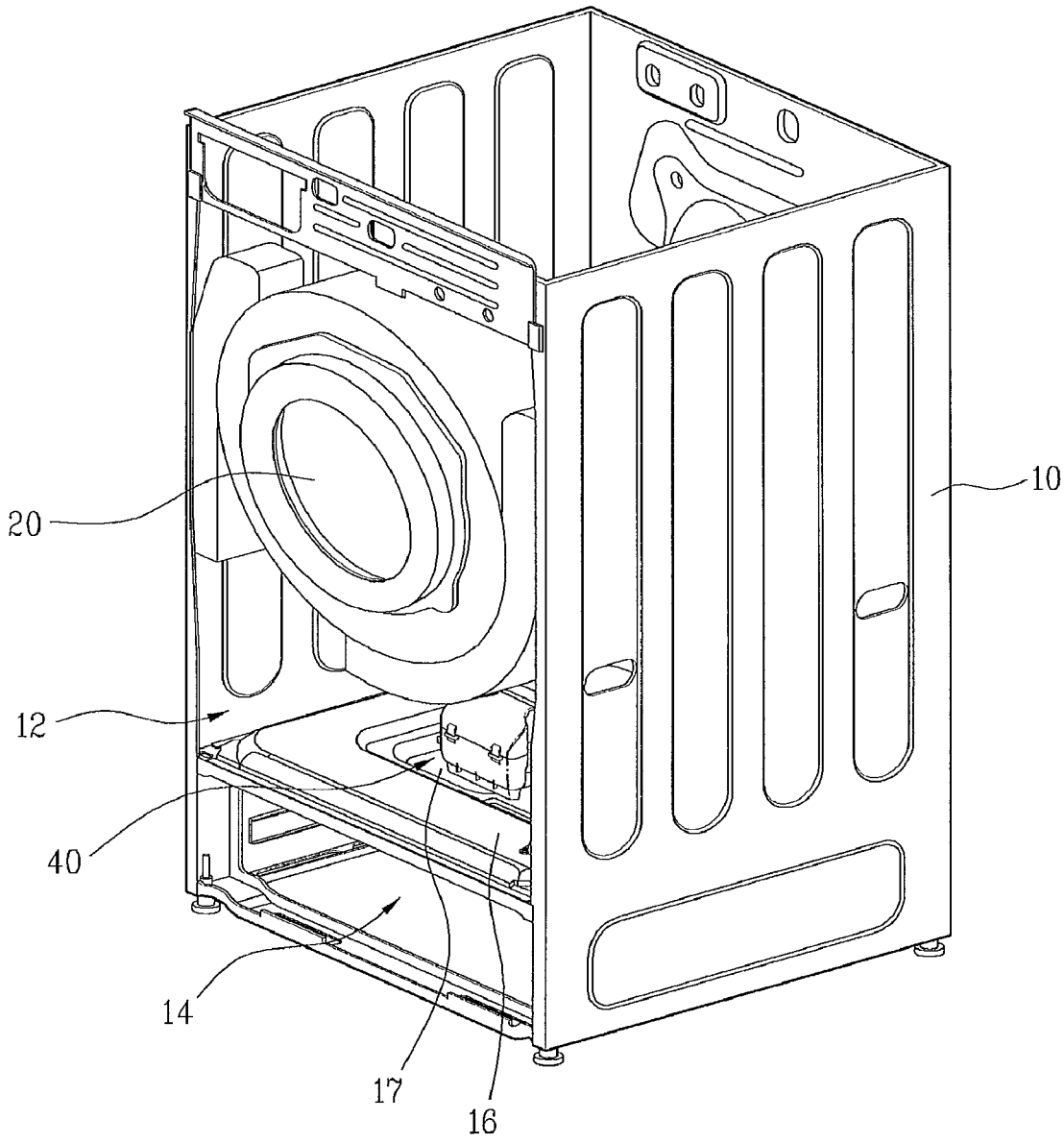
FIG. 8 is a perspective view illustrating a laundry machine according to another exemplary embodiment of the present invention.

The cabinet 10 may be formed of two separate members to include the first space 12 and second space 14. More particularly, the cabinet 10 may included a pair of first sidewalls at opposing sides of the first laundry treatment space 12, and a pair of second sidewalls at opposing sides of the second laundry treatment space 14, the pair of first sidewalls being contiguous with the pair of second sidewalls. Alternatively, the cabinet 10 may be formed of a single member. In one embodiment, the first space 12 and the second space 14 are formed within the cabinet 10 formed of a single member. More particularly, the cabinet 10 may include a first sidewall and a second sidewall, each of the first and second sidewalls extending continuously and uninterrupted from the first laundry treatment space 12 to the second laundry treatment space 14, as shown, for example, in FIG. 8. If the first space 12 and the second space 14 are formed in the cabinet 10 formed of the single member, the assembly work of the cabinet 10 will be simple and the necessary time for assembly will be reduced accordingly.

According to the washing machine of this embodiment, the cabinet 10 formed of a single member includes the first space 12 and the second space 14, and it further includes the partition 16 which partitions the inner space of the cabinet into the first space 12 and the second space 14. The partition 16 may be embodied as a wall located within the cabinet 10 that extends between the first sidewall and the second sidewall. The partition 16 divides the inner space horizontally into an upper space corresponding to the first space 12 and a lower space corresponding to the second space 14. However, the present invention is not limited to the above.

That is, according to this embodiment, the cabinet 10 includes the partition 16 which is simultaneously employed as a base of the first space 12 and as a top cover of the second space 14. More particularly, the partition 16 has a first side and a second side, the first side being exposed to the first laundry treatment space 12, and the second side being exposed to the second laundry treatment space 14.

Because the single partition 16 is employed as the base of the first space 12 and the top cover of the second space 14, the assembly work will be remarkably simple and the time necessary for the assembly work will be reduced, compared with a case of including a separate base of the first space 12 and a separate top cover of the second space 14. The provision of a single partition 16, as compared to a separate partition for each of the first and second spaces 12, 14, provides a simple structure for the laundry machine as a whole, and provides a good overall appearance to the laundry machine. In addition, the use of a single partition 16 simplifies assembly, and reduces costs due to the reduction in necessary material as compared with the use of separate partitions. Finally, a single partition 16 permits effective utilization of the first and second spaces 12, 14, and ease of access to the first space 12.

In addition, the laundry machine may further include an air supply unit 40 for supplying air or heated air to the second space 14.

The air supply unit 40 may be provided in the first space 12 and it is envisioned that the air supply unit is provided at a top surface of the partition 16. The partition 16 includes an aperture 15 therein so that air is supplied through the partition 16 and into the second laundry treatment space 14. The air supply unit 40 includes an air outlet that may be directly connected to the aperture 15 in the partition 16. The aperture 15 is located in a central portion of the partition.

The rotatably oriented drum 20 may be provided within the first space 12, and the drawer 30 may be provided within the second space 14. The volume of the first space 12 may be substantially larger than the volume of the second space 14. As a result, to utilize the inner space efficiently, it is envisioned that the air supply unit 40 is provided in the first space 12, rather than in the second space 14. Such an arrangement permits the amount of interior volume of the second space 14 available to receive laundry to be maximized. In addition, providing the air supply unit 40 outside of the second space 14 simplifies the structure of the second space 14 and provides more freedom of design of the second space 14. Finally, because the interior of the second space 14 is readily accessible by a user via the drawer 30, placing the air supply unit 40 in an area other than the second space 14 provides an additional level of safety for the user.

The arrangement of the air supply unit 40 in the first laundry treatment space 12 with the air being supplied through the aperture 15 in the partition 16 provides a mainly downwardly-directed airflow into the second laundry treatment space 14. This downwardly-directed airflow is particularly beneficial for drying or treating shoes 100, because the air is provided downwardly to the upper of the shoe 100 to envelope the upper of the shoe 100 with the airflow, in contrast to a horizontal airflow which may only be directed at one side of a shoe, or an upwardly directed airflow which would be blocked by the sole of the shoe.

In addition, the downwardly-directed airflow is directed toward the bottom of the drawer and then will tend to spread out in all directions, providing well distributed air flow and reducing possible dead zones with little or no airflow in the drawer 30.

More particularly, the drawer 30 includes a bottom wall and a plurality of sidewalls that define an enclosed space having an open top side. The height of the sidewalls may be less than the width and depth dimensions of the drawer 30 so that the outlet of the airflow from the air supply unit 40 is relatively close to the bottom of the drawer so that the drawer bottom tends to redirect the downwardly-directed airflow outwardly in all directions. The drawer bottom and the plurality of side walls may be configured to prevent air from passing therethrough so as to maximize the amount of air that is redirected upwardly. However, it is envisioned that the drawer bottom and/or the drawer sidewalls may include one or more apertures, such as a series of small ventilation holes, mesh or screening, to permit some of the airflow to pass there through.

The air supply unit 40 may be detachably provided on the partition 16, and more particularly, on the upper side of the partition 16. Here, a recess portion 17 may be provided on the partition 16 to accommodate the air supply unit 40. More specifically, a central portion of the partition 16 includes a recessed portion (or recess) 17 extended downwardly in an upper side of the partition 16, and as such, a lower side of the partition includes an upwardly extended portion surrounding the central portion, the details of which will be described later in the discussion regarding airflow recirculation.

The drum 20 is positioned in the first space 12 above the partition 16, and therefore it is possible that water may fall on the partition 16 because of the rotation of the drum during a washing, rinsing or drying-spinning cycle. As a result, the recess portion 17 may also collect the water falling onto the partition 16. In addition to that, the recess portion 17 accommodates the air supply unit 40. As a result, although not shown in the drawings, a water drainage structure may be provided at a predetermined portion of the recess portion 17 to drain the collected water without contacting the air supply unit 40. Alternatively, a bottom surface of the recess portion 17 may slope enough so that the collected water does not flow toward the air supply unit 40.

In reference to FIG. 2, the air supply unit 40 may be provided on the partition 16, and it can supply heated air to the second space 14. Specifically, the air supply unit 40 heats air from inside the first space 12 of the cabinet 10 and supplies the heated air to the second space 14. Here, the air inside the first space 12 will flow downwardly toward the second space 14 after being heated by the air supply unit 40. The downwardly-directed airflow is directed toward the bottom of the second space 14 and then will tend to spread out in all directions, providing well distributed air flow and reducing possible dead zones with little or no airflow in the second space 14.

Thus, the first space 12 forms a predetermined space where air is drawn into the air supply unit 40, that is, an air drawing space, and the second space 14 forms a predetermined space where air inside the air supply unit 40 is discharged, that is, an air discharging space. From a view of the air supply unit 40, the first space 12 is positioned on an air drawing path and the second space 14 is positioned on an air discharging path. As a result, an auxiliary inlet or outlet path for the air supply unit 40 does not have to be provided. The air supply unit 40 is configured to supply the air into the second laundry treatment space 14 without passing through the drum 20.

Figure 3:
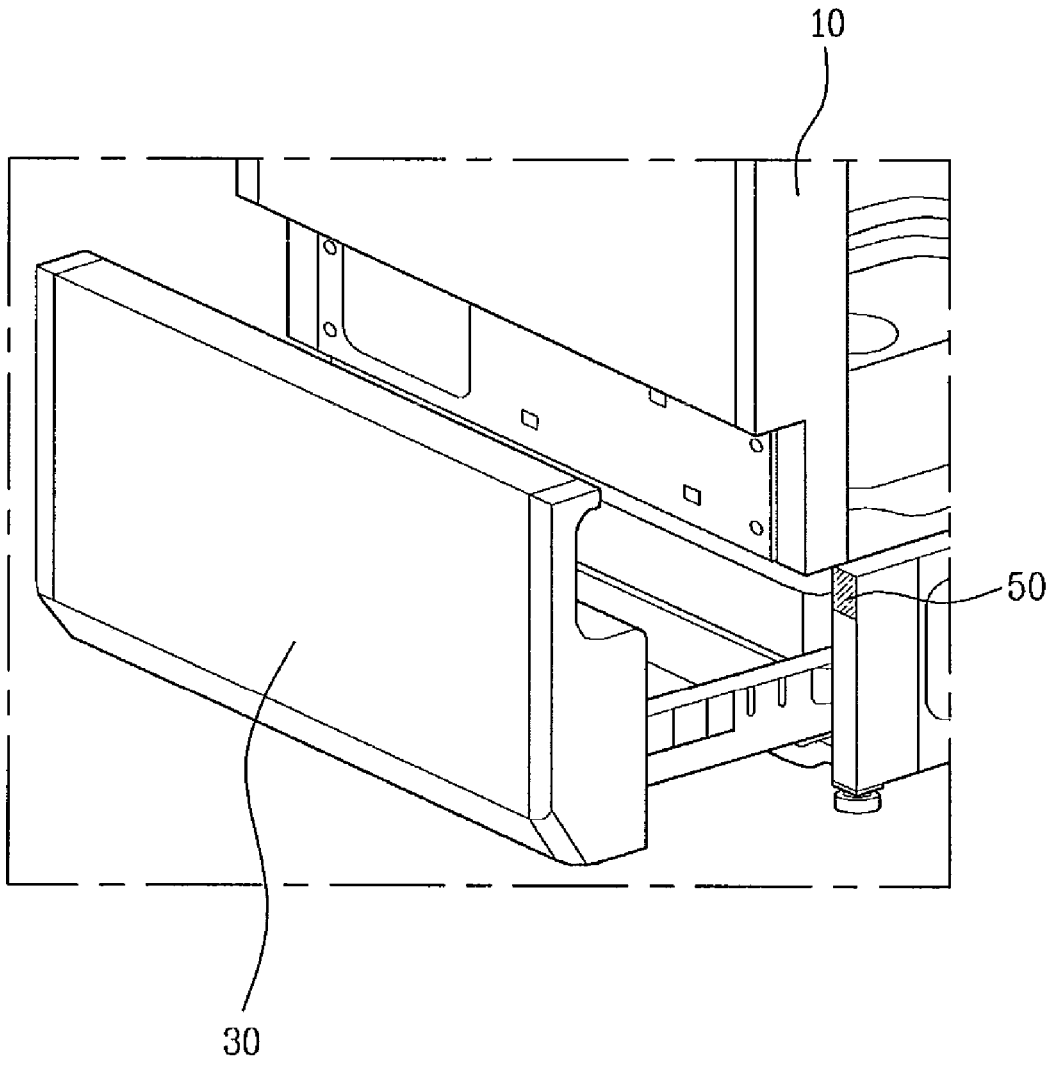
FIG. 3 is a perspective view illustrating a front portion of a detachable drawer provided in a cabinet of FIG. 1.

FIG. 3 is a perspective view illustrating a front view of the detachable drawer 30 provided in the second space 14 of the cabinet 10.

In reference to FIG. 3, the drawer 30 has an enclosed space with an open top. More particularly, the drawer 30 includes a bottom wall and a plurality of sidewalls that define an enclosed space having an open top side. The drawer 30 substantially occupies an entirety of the second laundry treatment space 14. An accommodating space is formed in the drawer 30 and the accommodating space receives the laundry therein. After the washing or drying process of the laundry in the first space 12, a user introduces the washed or dried laundry in the drawer 30 provided in the second space 14 to operate an auxiliary treating or refreshing process. The drawer bottom and/or the drawer side walls may include a plurality of apertures, such as a plurality of small ventilation holes, mesh or screening, to permit air to pass therethrough.

Undesirable smells of laundry used one or two times may be removed by a deodorization filter (not shown) or a fragrance addition unit (not shown), which may be further provided in the drawer 30 according to this embodiment. The deodorization filter removes the odors of the laundry and the fragrance addition unit supplies fragrance to the laundry such that the user may feel pleasant when wearing the laundry. The filter or fragrance addition unit may be provided in the second space 14, specifically, in a front portion inside the drawer 30.

During the operation of the air supply unit 40, the user may happen to open the drawer 30 by the user's mistake or the like. Therefore, the laundry machine according to this embodiment may further include a sensing part 50 for sensing a position of the drawer 30.

The sensing part 50 may monitor the position of the drawer 30 and it is envisioned that the sensing part 50 senses whether the drawer 30 is sliding open. For example, the sensing part 50 may be configured as a limit switch sensing whether the drawer 30 is sliding outward.

In case the drawer 30 is sliding open outwardly, the sensing part 50 generates an open signal, and the open signal is transmitted to a control part (not shown) of the laundry machine. The control part controls the air supply unit 40 according to the open signal of the sensing part 50. Once receiving the open signal from the sensing part 50, the control part powers off the air supply unit 40 to prevent heated air from being directed toward the user. If the sensing part 50 is configured as a limit switch, the limit switch directly switches off the air supply unit 40 when the drawer 30 is sliding open.

Figure 5:
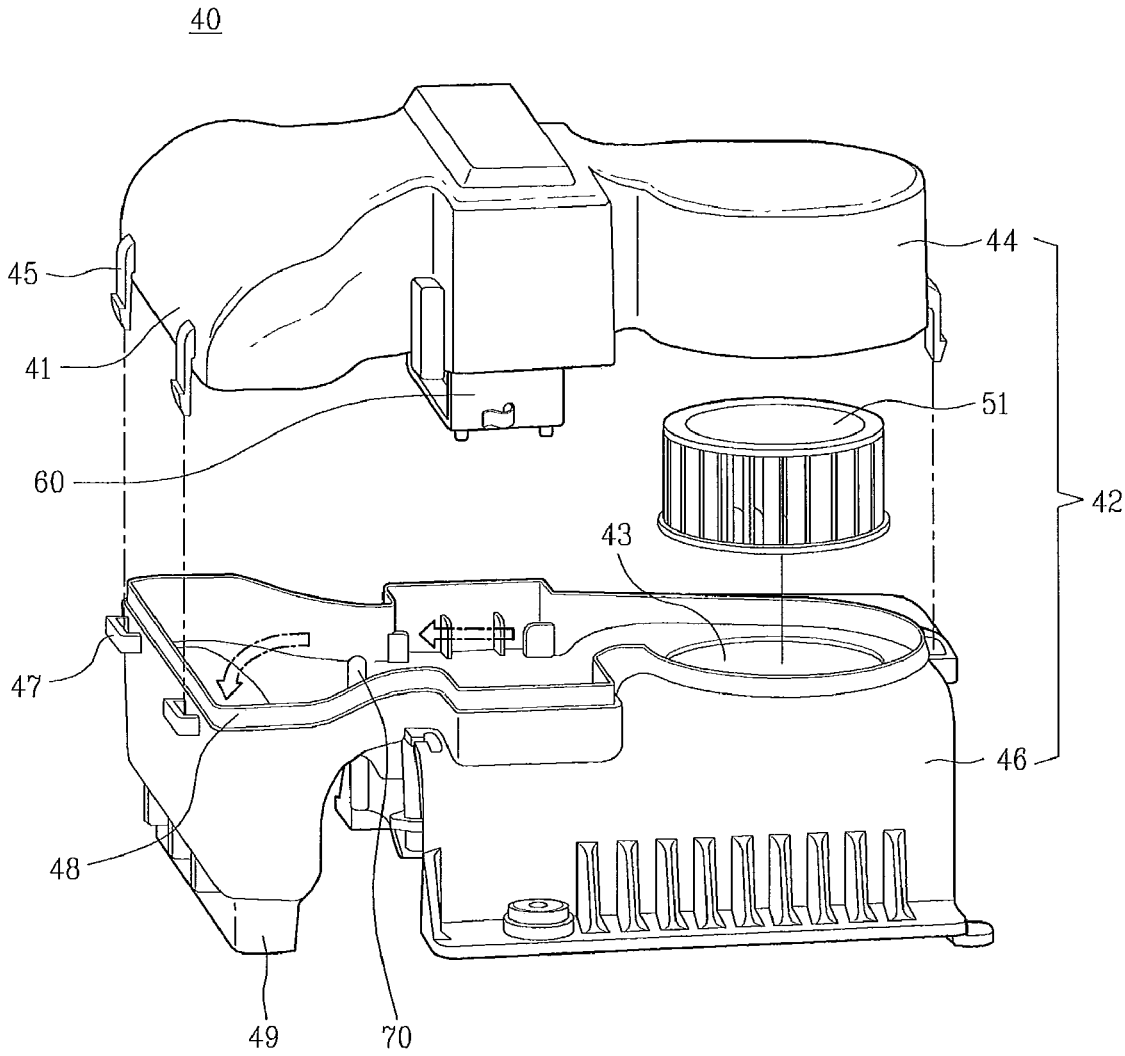
FIG. 5 is a perspective view illustrating a state of an upper housing shown in FIG. 4 being separated from a lower housing.

Referring to FIG. 5, the air supply unit 40 according to this embodiment includes a fan 51 for blowing air inside the air supply unit 40, and a heating part 60 for heating the air. A control part is provided that controls the air supply unit 40. The control part powers off the heating part 60 first, and then the fan 51 is powered off after a predetermined time period has elapsed after the heating part 60 has been turned off. If the heating part 60 is operated, the temperature inside the cabinet 10 increases. When the fan is turned off after a predetermined time period has elapsed after turning off the heating part 60, for example, one or two minutes, the air inside the cabinet 10 will be circulated during the one or two additional minutes, and the temperature inside the cabinet 10 will decrease accordingly.

Although not shown in the drawings, the laundry machine according to this embodiment may include an alarming part configured to warn the user visually or auditorily whether the drawer 30 is sliding open. Once the sensing part 50 generates and transmits the open signal to the control part, the control part turns off the air supply unit 40 and it controls the alarming part to inform the user of the open state of the drawer 30. Then, the user notices that the drawer 30 is open and takes corrective action, for example, closing the drawer 30 and re-operating the air supply unit 40.

If the operation of the laundry machine is stopped by the open state of the drawer 30, the laundry machine may display the remaining amount of the operation time of the selected course such that the user may recognize how much time of the selected course is remaining, and the user may determine to re-operate the laundry machine or to take out the laundry.

The air supply unit 40 which supplies heated or unheated air to the drawer 30 will now be described in detail.

Figure 4:
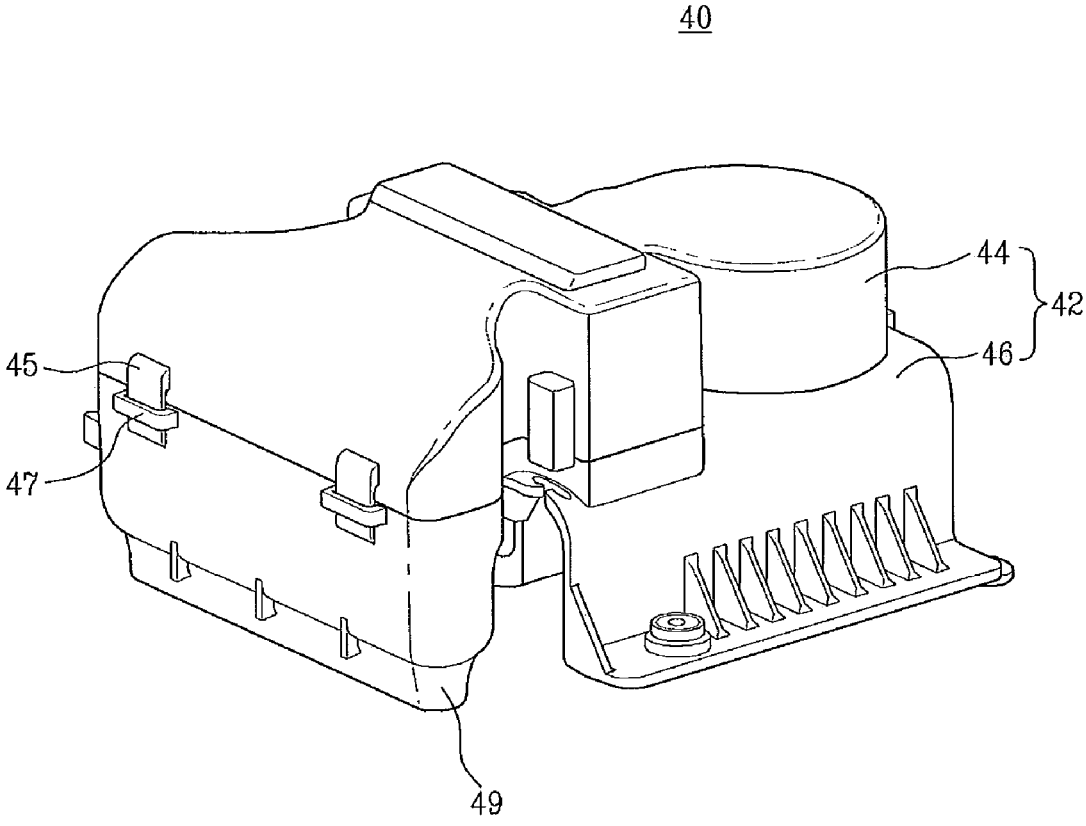
FIG. 4 is a perspective view illustrating an air supply unit shown in FIG. 1.

Referring now to FIGS. 4 and 5, the air supply unit 40 according to this embodiment includes a housing 42. The housing 42 is detachably connected to a top surface of the partition 16, and it forms an air flow path.

The housing forms the air flow path through which the air flows along, and in the housing 42 may be provided the fan 51, the heating part 60 and the sub-control part which will be described later.

Here, the housing 42 would be formed as one body that includes an upper housing 44 and a lower housing 46. The lower housing 46 is detachably coupled to the top surface of the partition 16 by, for example, one or more projections 94 received in corresponding slots in the partition 16, and one or more bosses 92 through which a fastener is passed and secured to the partition 16. The upper housing 44 is detachably coupled to the lower housing 46 by a plurality of hooks 45 provided on the upper housing 44 and a plurality of engaging members 47 provided on the lower housing 46. The detachable upper and lower housings 44 and 46 make it simple and convenient to repair inner components of the air supply unit 40 for maintenance.

A plurality of ribs 90 may be provided on the lower housing 46 to reinforce the lower housing 46. The ribs 90 may be arranged along both sides of the lower housing 46. The housing 42 may also include wire fixing members 82 and 84 for constraining wires connecting internal components of the air supply unit 40 with the outside.

The air supply unit 40 may be positioned on the top surface of the partition 16, that is, below the drum 20 (see FIG. 1) as mentioned above. When the drum 20 is operated, water may fall on the air supply unit 40. If the water enters into the housing 42, the inner components of the housing 42 such as the heating part 60 could malfunction or be damaged. Especially, if the upper housing 44 and the lower housing 46 of the housing 42 are formed of separate members, respectively, the water may pass through the connection portion between them. Because of that, the air supply unit 40 according to this embodiment may include a water penetration preventing part for preventing the water from penetrating through the connection portion between the upper housing 44 and the lower housing 46.

Specifically, the water penetration preventing part includes a first extending portion 41 which extends downward from an edge of the upper housing 44 and a second extending portion 48 which extends upward from an edge of the lower housing 46.

Here, the first extending portion 41 is formed along a rim of the upper housing 44, encircling a predetermined portion of a rim of the lower housing 46, and thereby covering the rim of the lower housing 46. The second extending portion 48 is coupled to the first extending portion 41, specifically, to an inside of the first extending portion 41. As a result, the water on the top of the housing 42 flows along a surface of the first extending portion 41 sequentially, not passing into the housing 42 along the connection portion, and it falls toward the partition 16.

As mentioned above, the path of the airflow is in the housing. The path is formed between the lower housing 46 and the upper housing 44, and air flows along the path shown as an arrow in FIG. 5. The fan 51 for blowing air along the path and the heating part 60 for heating the air may be provide inside the housing. Although it is shown in FIG. 5 that the fan 51 and the heating part 60 are arranged sequentially along the flowing direction of the air so that the fan 51 blows air to the heating part 60, the present invention is not limited thereto and it is also possible to arrange the heating part 60 and the fan sequentially so that the fan 51 draws air from the heating part 60. The fan 51 is a centrifugal fan in the embodiment shown. However, it is envisioned that alternative fan designs such as an axial fan or scirocco fan may be used.

Once the fan 51 is put into operation, air outside the housing 42 is drawn into the housing 42 via an inlet 43. Here, it is envisioned that the rpm of the fan 51 is adjustable. Since the rotation speed of the fan 51 is adjustable, the amount of the air supplied by the fan 51 may be adjustable. The air drawn into the housing 42 is heated by the heating part 60 and the heated air is discharged through an outlet 49. In this case, the outlet 49 is connected with the aperture 15 (see FIG. 2) forming a heated air inlet in the partition 16, and is directed downwardly. It is envisioned that the outlet 49 is approximately perpendicular to the heated air inlet 15, and is directly connected with the heated air inlet 15. As a result, the heated air may flow downwardly toward the second space 14, that is, the drawer 30.

Figure 6:
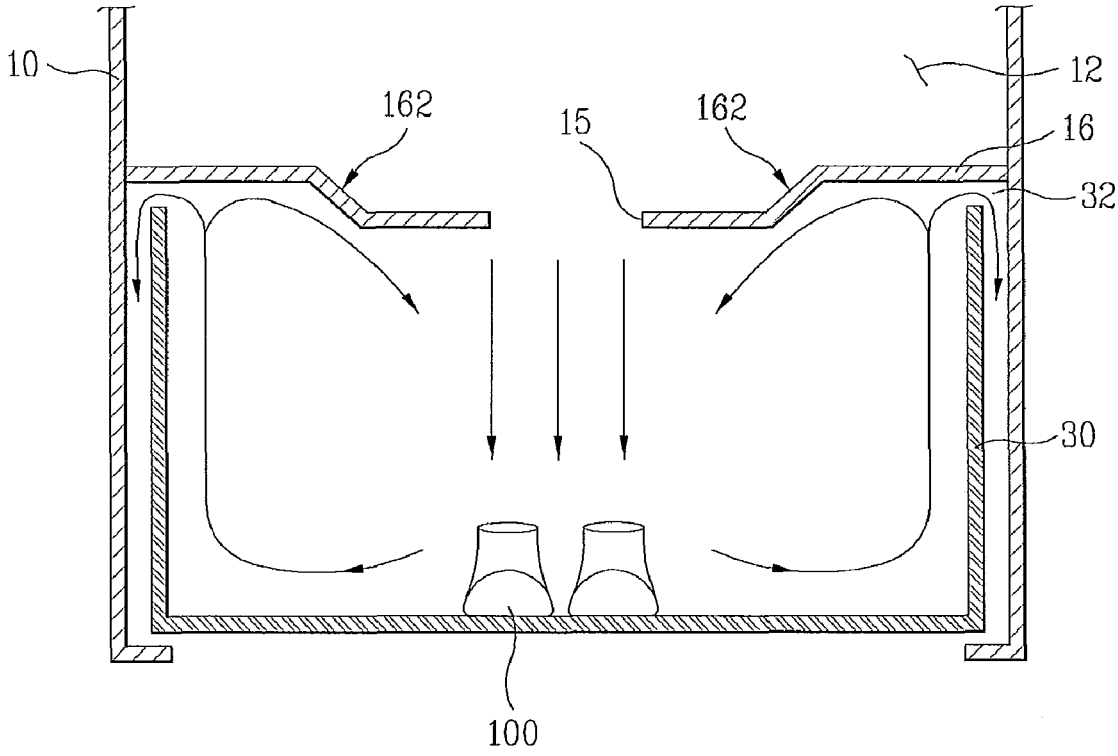
FIG. 6 is a diagram schematically illustrating flow of air inside the drawer.

FIG. 6 is a diagram schematically illustrating the flow of the air supplied to the drawer 30 by the air supply unit 40.

Referring to FIG. 6, the air discharged via the outlet 49 passes the heated air inlet 15, and the air flows toward a side upper portion inside the drawer 30 via a center lower portion. Because of that, a dead zone inside the drawer 30, which air fails to reach, may be reduced as much as possible. Also, as shown in FIG. 2, the lower side of the partition 16 may have an upwardly extended portion surrounding the recessed portion in the upper side of the partition 16. This upwardly extended portion may include inclined portions 162 configured to redirect airflow inwardly toward the central portion of the partition 16, and downwardly away from the partition 16, and back toward the drawer 30. This arrangement permits some of the air to be recirculated, which may promote heating, drying or other treatment of laundry in the drawer 30.

As shown in FIG. 6, a gap 32 is provided between the partition 16 and the drawer 30 to permit air to pass therethrough and exit the drawer 30 for subsequent exiting of the second laundry treatment space 14. Also, if the laundry is put on a bottom surface of the drawer 30, air can contact with the laundry as much as possible. The bottom of the drawer 30 tends to redirect the downwardly-directed airflow outwardly in all directions toward the drawer sidewalls. Thereafter, the drawer sidewalls tend to redirect the airflow upwardly toward the partition 16. Finally, the partition 16 tends to redirect the airflow inwardly toward the central portion of the partition 16, where the airflow joins with the downwardly-directed airflow, and is recirculated.

Referring to FIGS. 4 and 5 again, the air supply unit 40 according to this embodiment may further include a first temperature sensor 70 which senses the temperature of the heated air. The heating part 60 may be controlled according to the temperature values monitored by the first sensor 70 to supply the heated air.

This first sensor 70 may be provided in a predetermined portion inside the path and it is envisioned that the first temperature sensor 70 is provided at an end of the path, that is, adjacent to the outlet 49. The sub-control part provided in the air supply unit 40 controls the operation of the heating part 60 according to the temperature values measured by the first temperature sensor 70 and then it controls the temperature of the heated air supplied to the second space 14.

When the heating part 60 is controlled by sensing the temperature of the heated air heated by the heating part 60, a single control part may be provided or two or more control parts may be provided.

If at least two control parts are provided, for example, a main-control part and a sub-control part, a main-control part controls an overall operation of the drum 20 and the air supply unit 40. The temperatures measured by the first temperature sensor 70 may be transmitted to the main-control part.

The main-control part controls the operations of the heating part 60 and the fan 51 composing the air supply unit 40 according to temperatures monitored by the first temperature sensor 70. In this case, a command signal generated by the main-control part is transmitted to the sub-control part provided in the air supply unit 40. Hence, the sub-control part controls the operations of the heating part 60 and the fan 51 according to the command signal of the main-control part. If receiving the command signal from the main-control part, the sub-control part may perform only the on and off control of the heating part 60 or the fan 51 in order to simplify the configuration.

The heating part 60 positioned along the air path heats the air to produce heated air. It is envisioned that the heating part 60 has a configuration to heat only the air, and minimize the transmission of the heat to the housing 42.

Figure 7:
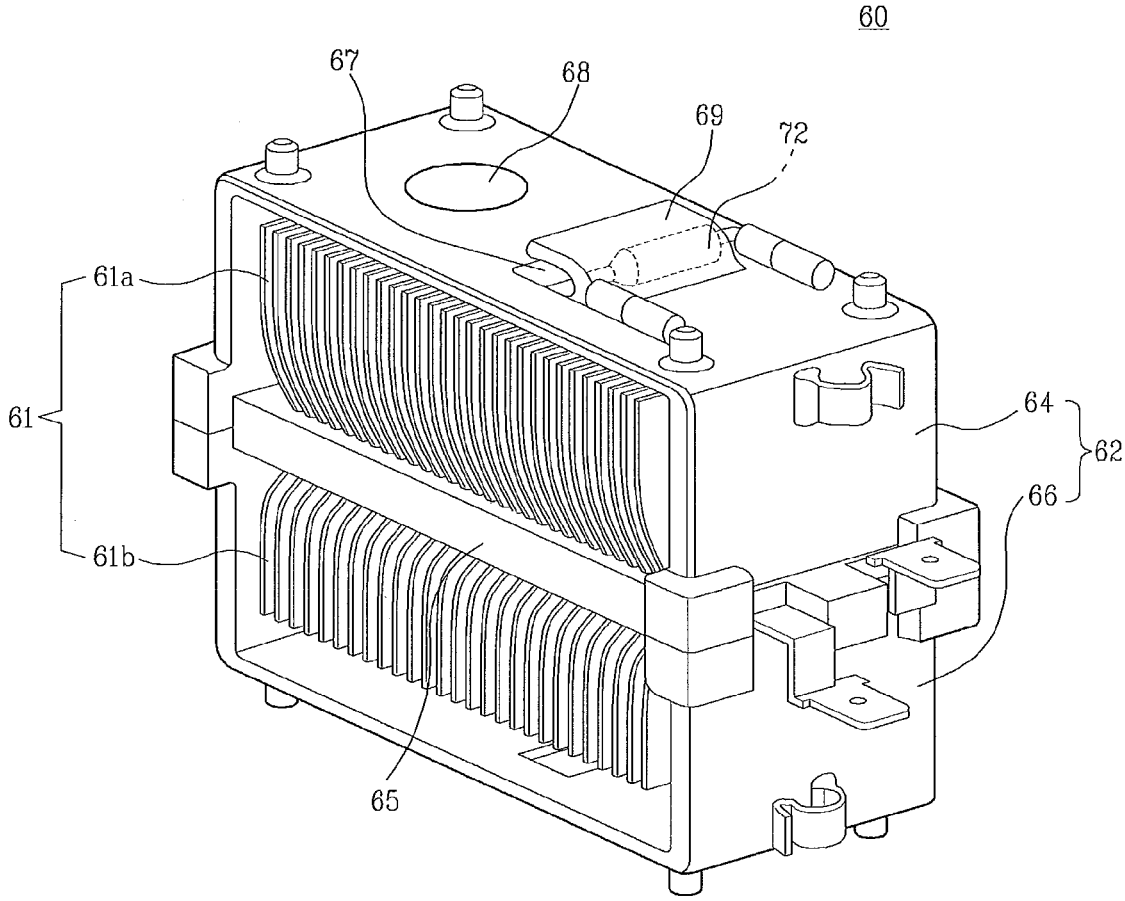
FIG. 7 is a perspective view illustrating a heating part of FIG. 5.

FIG. 7 is a perspective view illustrating only the heating part 60 shown in FIG. 5.

Referring to FIG. 7, the heating part 60 provided in the air supply unit 40 according to this embodiment may include a heater 61 for heating the blown air, and a case 62 for accommodating the heater 61. The case 62 forms a path through which air flows and it supports the heater 61 to prevent the heat produced by the heater 61 from being transferred to the housing 42 (see FIG. 5).

Various heaters may be used within the air supply unit, including a PTC heater (Positive Temperature Coefficient Heater). A PTC heater is desirable because it is easy to control.

A single heater may be provided. However, it is envisioned that the heater may be horizontally divided into a first heater 61*a* and a second heater 61*b* along the path. The first and second heaters 61*a* and 61*b* are accommodated in an upper case 64 and a lower case 66, respectively. A partition wall 65 may be provided between the first and second heaters 61*a* and 61*b* to prevent the overheating of the heaters 61*a* and 61*b*.

Either or both of the heaters 61*a* and 61*b* may be operated selectively and simultaneously such that the air may be heated appropriately according to the amount of the air in order to save energy. Specifically, if the air amount is relatively small, either of the first and second heaters 61*a* and 61*b* is operated to heat the air. If the air amount is relatively large, both of the first and second heaters 61*a* and 61*b* are operated simultaneously to heat the air.

The case 62 prevents the heater 61 from directly contacting the inside of the housing 42, and supports the heater 61 to form the air path. As shown in FIG. 7, the case 62 may support the heater 61 in a way that does not interfere with the flow of the air along the heater 61. Because of that, the case may be fabricated with heat-resistant material having low heat conductivity, or heat insulating material.

The case 62 may be formed integrally of a single member, and it is envisioned that the case 62 may be formed of separate members which will be assembled. Specifically, the case 62 shown in FIG. 7 includes the upper case 64 and the lower case 66 which are coupled to each other. Providing the case 62 configured of the separate members makes it possible to perform disassembling and re-assembling operations easily for repairing work.

Because the heater 61 according to this embodiment is closely adjacent to the housing 42 of the air supply unit 40, the case 62 may prevent the heat of the heater 61 from being transmitted to the housing 42 along a vertical direction, not simply preventing the heater 61 from contacting with the inside of the housing 42. That is, although the heat of the heater 61 could be transmitted to the air flowing along the path, the heat will not be transmitted toward the housing 42 positioned opposite to the air path.

Specifically, as shown in FIG. 7, the upper case 64 covers the upper heater 61*a* and the lower case 66 covers the lower heater 61*b*. The air passes the case 62 via the open portions of the upper case 64 and the lower case 66, for example, from a left to right direction. In this way, the heater 61 may not directly contact the housing 42 by way of the case 62, and the heat generated by the heater 61 may be prevented from flowing to the walls of the housing 42 by the upper and lower cases 64 and 66. Additional safety features are incorporated into the heating part 60. For example, the heating part 60 includes contact terminals for supplying electricity to the heater 61. As shown in FIG. 7, the contact terminals are spaced from one another in both a horizontal direction and a vertical direction.

If the heating part 60 is operated without sufficient supplied air, the temperature of the heater 61 may increase too much, and it is possible that the heater 61 may be damaged. Because of that, an overheat prevention means may be provided in this embodiment.

Specifically, the heating part 60 according to this embodiment may further include a second temperature sensor 68 which senses the temperature of the heater 61. In addition to the first temperature sensor 70 (see FIG. 5) for sensing the temperature of the heated air, the second temperature sensor senses the temperature of the heater 61. The second temperature sensor 68 is positioned adjacent to the heater 61 to monitor the temperature of the heater 61. The measured temperature values may be transmitted to the control part including the main-control part and the sub-control part. If the transmitted temperature is over a predetermined value, the control part, specifically the main-control part, determines that the heater 61 is overheated and it controls the heater 61 to be turned off. In case the sub-control part is provided, the sub-control part receives a corresponding command from the main-control part and turns off the heater 61.

In addition to the second temperature sensor 68, a thermal fuse 72 may be provided as an overheating prevention means for turning off the heater 61. As shown in FIG. 7, the thermal fuse 72 may be provided in the case 62.

Specifically, an open portion 67 is provided in the upper case 64, and the thermal fuse 72 is positioned in the open portion 67. The heat of the heater 61 is transmitted to the thermal fuse 72 via the open portion 67 such that the heat may be sensed more efficiently.

If such an open portion 67 is formed, the heat of the heater 61 flows out of the case 62 via the open portion and directly to the housing 42. As a result, the heating part 61 according to this embodiment includes a closing member 69 for closing the open portion 67 to prevent the heat of the heater 61 from directly flowing to the housing 42. The closing member 69 may be formed as a separate member and it is envisioned as shown in FIG. 7 that the closing member 69 may be formed integrally with the upper case 64. Here, the closing member 69 is configured to cover the open portion 67, and includes a bent portion, such that the heat may not flow toward the housing 42 via the open portion 67.

The thermal fuse 72 is connected with the heater 61. If the temperature of the heater 61 increases beyond the predetermined temperature, the thermal fuse 72 will cut off the electricity supplied to the heater 61 to prevent the overheating of the heater 61. As shown in FIG. 7, the closing member 69 is oriented perpendicular to the direction of airflow through the heater 61 to protect the housing 42 from excess heat while permitting the thermal fuse 72 to accurately detect a temperature of the heater 61 without being unduly affected by airflow through the open portion 67. For example, excess air flow through the open portion 67 could cause the thermal fuse 72 to inaccurately sense the temperature of the heater 61, and the heater 61 may not be adequately protected from overheating.

Although the laundry machine according to the above embodiment includes the air supply unit 40 having the heating part 60, the present invention is not limited thereto. For example, the laundry machine according to the present invention may include an air supply unit which ventilates air without the heater 61. If such an air supply unit is provided, the heater is not provided in the housing.

The operation of the laundry machine having the above configuration will now be described.

The user introduces the laundry into the drawer 30 of the cabinet 10 and selects an auxiliary course including a heated air cycle for supplying heated air or an air ventilation cycle for only ventilating air. If the heated air cycle is put into operation, the air supply unit 40 heats air and it supplies heated air toward the second space 14, that is, the drawer 30. Here, the first temperature sensor 70 monitors the temperature of the heated air and it controls the air supply unit. The second temperature sensor 68 or the thermal fuse 72 prevents the overheating of the heater 61.

If the drawer 30 is sliding open by the user's mistake or the like, the control part of the laundry machine powers off the air supply unit 40 according to the signal generated by the sensing part 50.

If the air ventilating cycle is put into operation, the heating part 60 may not heat the air and only the fan 51 is operated to supply air to the drawer 30. In case the air supply unit without the heating part 60 is provided, the fan 51 is operated by the control part and air is supplied.

The laundry machine according to the present invention has several advantages.

As mentioned above, the laundry machine according to the present invention includes the single partition employed as the base of the first space and the top cover of the second space. As a result, the assembly work of the laundry machine according to the present invention may be simple and efficient.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine, comprising:

a cabinet, the cabinet defining a first laundry treatment space configured to receive laundry therein and a second laundry treatment space configured to receive laundry therein;

a partition located within the cabinet, the partition being provided between the first laundry treatment space and the second laundry treatment space; and an air supply unit configured to supply air to the second laundry treatment space, wherein the partition includes an aperture through which the air is supplied to the second laundry treatment space, wherein a central portion of the partition includes a recess in an upper side of the partition, and a lower side of the partition includes an upwardly extended portion surrounding the central portion, and wherein the upwardly extended portion includes an inclined portion configured to redirect airflow inwardly toward the central portion, and downwardly away from the partition.

2. The laundry machine of claim 1, wherein the air supply unit is provided in the first laundry treatment space.

3. The laundry machine of claim 1, wherein the cabinet includes a first sidewall and a second sidewall, each of the first and second sidewalls extending continuously and uninterrupted from the first laundry treatment space to the second laundry treatment space.

4. The laundry machine of claim 1, further comprising a drawer provided in the second laundry treatment space, the drawer being configured to receive laundry therein.

5. The laundry machine of claim 4, wherein a gap is provided between the partition and the drawer to permit air to passtherethrough.

6. The laundry machine of claim 4, wherein the drawer comprises a bottom wall and a plurality of sidewalls, the bottom wall and the sidewalls defining an enclosed space having an open top side.

7. The laundry machine of claim 6, wherein the bottom wall and the plurality of sidewalls are configured to prevent air from passing therethrough.

8. The laundry machine of claim 4, wherein the drawer comprises a bottom wall having a width and depth, and a plurality of sidewalls having a height, wherein the height is less than the width and less than the depth.

9. The laundry machine of claim 1, wherein the first laundry treatment space comprises a laundry washing apparatus.

10. The laundry machine of claim 1, wherein the first laundry treatment space comprises a laundry drying apparatus.

11. The laundry machine of claim 1, further comprising a pair of first sidewalls at opposing sides of the first laundry treatment space, and a pair of second sidewalls at opposing sides of the second laundry treatment space, the pair of first sidewalls being contiguous with the pair of second sidewalls.

12. The laundry machine of claim 1, wherein the partition has a first side being exposed to the first laundry treatment space and a second side being exposed to the second laundry treatment space.

13. A laundry machine, comprising:

a cabinet, the cabinet defining a first laundry treatment space configured to receive laundry therein and a second laundry treatment space configured to receive laundry therein;

a drum provided in the first laundry treatment space;

a partition located within the cabinet, the partition being provided between the first laundry treatment space and the second laundry treatment space; and an air supply unit configured to supply air to the second laundry treatment space, wherein the air supply unit is configured to provide the air into the second laundry treatment space without passing through the drum.

14. A laundry machine, comprising:

a cabinet, the cabinet defining a first laundry treatment space configured to receive laundry therein and a second laundry treatment space configured to receive laundry therein;

a partition located within the cabinet, the partition being provided between the first laundry treatment space and the second laundry treatment space;

an air supply unit configured to supply air to the second laundry treatment space;

a drum provided in the first laundry treatment space, the drum being configured to receive laundry therein; and a drawer provided in the second laundry treatment space, the drawer being configured to receive laundry therein, wherein the air supply unit is provided in the first laundry treatment space.

15. The laundry machine of claim 14, wherein the partition has a first side being exposed to the first laundry treatment space and a second side being exposed to the second laundry treatment space, wherein the partition includes an aperture;

wherein the air supply unit is provided at the first side of the partition, wherein the air supply unit is connected to the aperture, and wherein the air is supplied into the second laundry treatment space through the aperture.

16. The laundry machine of claim 15, wherein a central portion of the partition includes a recess at the first side of the partition, and the second side of the partition includes an upwardly extended portion surrounding the central portion, and wherein the upwardly extended portion includes an inclined portion configured to redirect airflow inwardly toward the central portion, and downwardly away from the partition and toward the drawer.

* * * * *